US007213809B2

(12) United States Patent
Vedoy et al.

(10) Patent No.: US 7,213,809 B2
(45) Date of Patent: May 8, 2007

(54) TRANSLATION TABLE FOR SHEET FEEDER

(75) Inventors: Arild Vedoy, Forest Lake, MN (US); Mark F. Nordling, Mahtomedi, MN (US)

(73) Assignee: Multifeeder Technology, Inc., White Bear Lake, MN (US)

( * ) Notice: Subject to any disclaimer, the term of this patent is extended or adjusted under 35 U.S.C. 154(b) by 318 days.

(21) Appl. No.: 10/930,627

(22) Filed: Aug. 31, 2004

(65) Prior Publication Data

US 2006/0071408 A1 Apr. 6, 2006

(51) Int. Cl.
*B65B 1/04* (2006.01)

(52) U.S. Cl. ..... 271/296; 271/288; 53/246; 53/251

(58) Field of Classification Search ..... 271/288, 271/296, 298–299; 53/244, 246, 250, 251
See application file for complete search history.

(56) References Cited

U.S. PATENT DOCUMENTS 4,161,092 A * 7/1979 Buday et al. ..... 53/244
6,086,061 A * 7/2000 Vedoy et al. ..... 271/3.01
6,644,644 B2 * 11/2003 Vedoy ..... 271/3.03
7,040,613 B2 * 5/2006 Vedoy ..... 271/10.07

FOREIGN PATENT DOCUMENTS

JP 3-279114 * 12/1991

* cited by examiner

*Primary Examiner*—Patrick MacKey
*Assistant Examiner*—Jeremy R Severson
(74) *Attorney, Agent, or Firm*—Steven E. Kahm; Nikolai & Mersereau, P.A.

(57) ABSTRACT

A linear translation table for use in conjunction with a sheet feeding machine and a conveyor for laterally translating the sheet feeding machine over rows of product receiving portions of boxes or blisters in sheets of bubble packaging such that the sheet feeding machine can deliver product in an array of rows and columns of product receiving portions as the linear translation table is pitched. The rows of product receiving portions are indexed and linear translation table reverses direction to fill the next row. A controller on the linear translation table is programmed for the distance between columns and stops long enough for the sheet feeder to dispense a product into the product receiving portion. In this manner boxes with rows and columns of segments to be filled with product or formed pocket sheets can be filled with a sheet feeding machine which normally only delivers product linearly.

7 Claims, 2 Drawing Sheets

TRANSLATION TABLE FOR SHEET FEEDER

BACKGROUND OF THE INVENTION

1. Field of the Invention

This invention relates to sheet feeding machines and more particularly to a translatable support of a sheet feeding machine such that product can be delivered to different lateral positions when the machine is translated.

2. Description of the Related Art

In the prior art a sheet feeding machine has been fixed in position and a tray, box, or slot on a conveyor belt in front of the sheet feeding machine would receive product counted out of the sheet feeding machine until the proper count was reached and then the tray would be emptied, box moved, or conveyor belt translated so that an empty tray, box or slot would be present in front of the sheet feeder to receive the next batch of product. Conveyor belts or other translator devices would move the batches of product along. However, for filling a sheet of packaging such as a blister pack tray, bubble pack or a box having rows with several receptacles in each row a means for translating the sheet feeder is required.

SUMMARY OF THE INVENTION

A linear motion table is provided which translates on at least one axis to fill sections of a box or a pocket pack sheet. The box or pocket pack sheet is indexed by row in front of the sheet feeding machine.

A table is provided with a pair of rods for supporting a translatable plate mounted on bearings riding on the rods. The plate translates back and forth on the rods.

A motor connected to a drive belt turns an idler shaft, which drives a pair of translation belts, which are attached to and move the plate. The motor moves the plate a known distance and stops so that a product can be delivered from the sheet feeder at that position. The motor is then turned on to move the plate a known distance to the next column in the row for adding the next unit of product. At the end of each row the motor reverses direction to translate the sheet feeder back and forth over a box, blister pack tray, or sheet of formed pockets.

A pair of switches along the wall of the table base can contact the plate and for reversing the direction of the motor and/or supply position information to the controller of the position of the sheet feeder.

The sheet feeder is coordinated with the translator to deliver product at the proper times to the proper locations. The sheet feeder can be translated and stopped in position to deliver one or more than one unit of product to a section of a box or a pocket in a sheet of formed pockets before being further translated. The sheet feeder is further coordinated with a conveyor belt or other means to index the rows of sections of boxes or pocket packs to the filled to align the rows with the sheet feeder.

OBJECTS OF THE INVENTION

It is an object of the invention to translate a sheet feeder on a table such that it delivers product to different locations within a stationary box or pocket pack to be filled.

It is an object of the invention to coordinate the translation of the sheet feeder with the indexing of the boxes or sheets of formed pockets and delivery of product from the sheet feeding machine.

It is an object of the invention to allow a sheet feeding machine to fill arrays of rows and columns in containers.

It is an object of the invention to program the sheet feeder, conveyor and translation table to work in cooperation with each other to fill sections of boxes or sheets of formed pockets with product.

Other objects, advantages and novel features of the present invention will become apparent from the following description of the preferred embodiments when considered in conjunction with the accompanying drawings.

DESCRIPTION OF THE PREFERRED EMBODIMENTS

Figure 1:
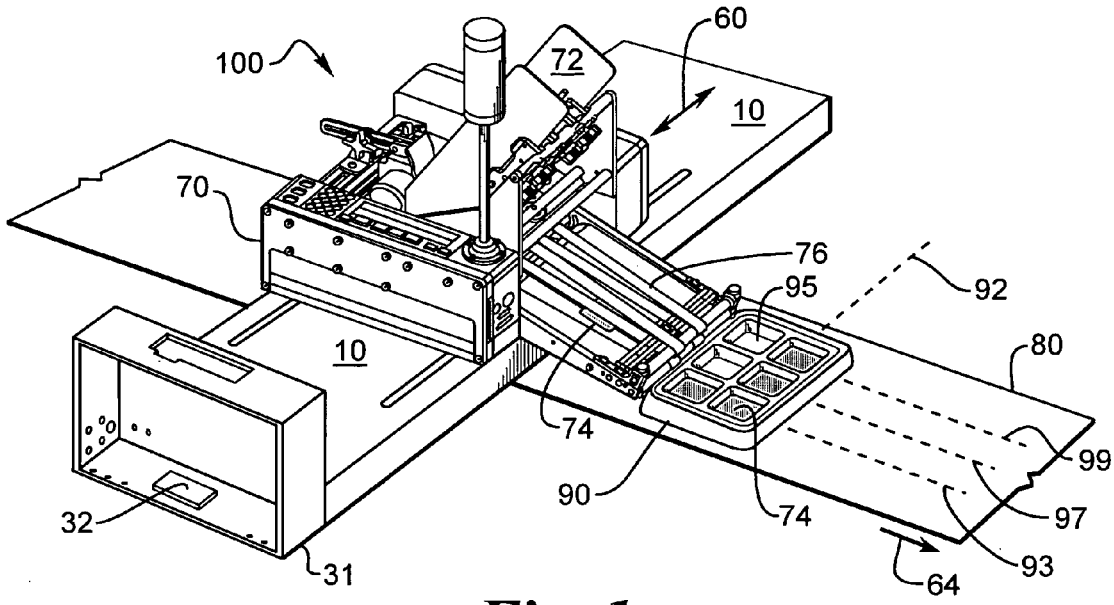
FIG. 1 is a perspective view of the sheet feeder on a translatable table adjacent a sectioned pocket pack sheet to be filled.
Figure 2:
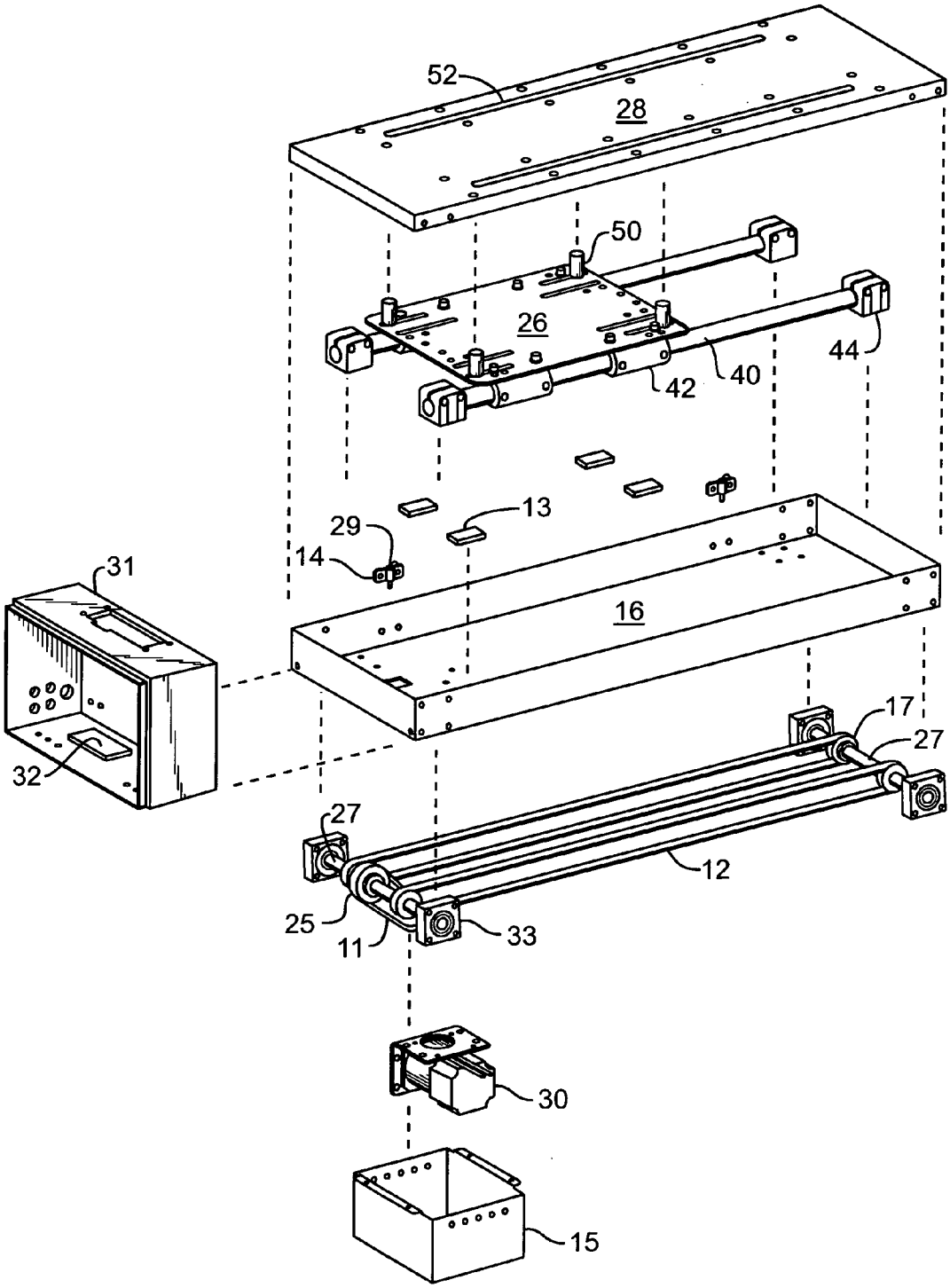
FIG. 2 is an exploded view of the linear motion table.

Sheet feeding machine 70 is designed to separate stacks of product placed in feeder stack 72 into individual products 74 for delivery by belts 76 into pockets 95 in sheets of formed pockets 90, or into sections of boxes. As shown in FIG. 1 the system 100 having a sheet feeder 70 on linear translation table 10 is translated by the linear motion table 10 in directions shown by arrows 60 to deliver product 74 to rows of pockets 95 in formed pocket pack sheet 90. After each row 92 in formed pocket sheet 90 is filled with product 74 the conveyor belt 80 is indexed to move the formed pocket sheet 90 in the direction shown by arrow 64 such that the next row 92 of pockets 95 is in position to receive product 74 from the sheet feeder 70. Sheet feeding machines 70 are well known and will not be described in detail.

The linear motion table 10 for translating the sheet feeder 70 has a table base 16 to which is attached a drive motor box 15 having a drive motor 30 therein. The drive motor 30 turns a drive belt 1, which engages drive belt pulley 25 to turn idler shaft 27. The idler shaft 27 extends between block bearings 33 which are attached to the table base 16 to hold the idler shafts 27 in place. The idler shafts 27 have translation belt pulleys 17 which engage translation belts 12 extending over translation belt pulleys 17 on the idler shafts 27 such that when the motor 30 is running the translation belts 12 will move. The translation belts 12 engage and move a translation plate 26 which is mounted on rods 40 by sliding bearings 42 preferably made from Teflon® or similar material and impregnated with a slippery substance, or in the alternative, sliding bearings 42 may be the roller bearings type. The rods 40 are held in place by blocks 44 which are attached to table base 16. The translation plate 26 is attached to the translation belts 12 by belt clamps 13 which sandwich the translation belts 12 between the belt clamps 13 and the translation plate 26.

A tabletop 28 is placed on top of the table base 16. The tabletop has slots 52 allowing posts 50 on translation plate 26 to extent therethrough for engaging and supporting the base of sheet feeder 70.

A control box 31 is attached at one end of the table base 16. The control box 31 has a controller 32 for coordinating the sheet feeder 70, the conveyor belt 80 and the linear motion table 10 such that product 74 is placed in the pockets 95 of a formed pocket sheet 90 when the conveyor belt 80 is stopped in a controlled space under the end of the sheet feeder's 10 product delivery belt 76.

The controller 32 in the control box 30 is used to index the conveyor belt 80 forward in direction 64 for a measured distance such that a succeeding row 92 of pockets 95 in the sheet 90 of formed pockets is under the end of the product delivery belt 76. When the rows 92 are properly aligned controller 32 translates the plate 26 such that the product 74 on the end of the delivery belt 76 will fall from the delivery belt 76 into the pocket 95 in a formed pocket sheet 90 in row 92 by first aligning with column 93 and stopping until product 74 is advanced by sheet feeder 70 and dropping into pocket 95. Then the linear motion table 10 is translated to column 97 and the product is again advanced until it is dropped into pocket 95. The linear motion table 10 is translated to column 99 and the product is again advanced until it is dropped into pocket 95. The conveyor 80 indexed the sheet 90 forward one row and product 74 is dropped into the pocket 95 in column 99 in the new row. The motor 30 now reverses to move the sheet feeder 70 into alignment with column 97 and stops until product 74 is placed in pocket 95.

Switches 29 on brackets 14, attached to table base 16, provide position information about the plate 26 to the controller 32 in control box 31. As the plate 26 engages switch 29 the position of the plate 26 is known. The controller 32 is programmed to know how many turns or portions of turns of the motor 30 are required to position the sheet feeder 10 over the next pocket 95 in the formed pocket tray sheet 90. Translatable plate 16 can be programmed by in the controller 32 to range from the first column 93 to the last column 99 stopping directly over each column. With the sheet feeding machine 10 stopped over the column the product delivery belt 76 is advanced until a unit of product 74 is delivered to the pocket 95 in the formed pocket sheet 90. The linear motion table 10 then moves to the next column and repeats the process until all columns in the row are filled. The controller then indexes the conveyor belt one unit forward in direction 64 for the next row 92 to move into position to receive product 74 from the sheet feeder 70 and the sheet feeder is turned on to drop product 74 into the pocket 95. The motor 30 then reverses direction to send the plate 26 and the sheet feeder 70 in the opposite direction 60 to fill the next row 92. The conveyor belt 80 is then indexed to the next row and the process repeats.

The controller 32 receives position information from switches 29 calibrates the position of the plate 26 to compensate for belt slippage or other positioning errors which may add up over time to misalign the sheet feeder for delivery of product relative to the pocket 95 in the formed pocket sheets 90.

The motor 30 preferably counts portions of each rotation such that it accurately sends information to the controller about the number of turns of the motor, which is directly related to the position of the product 74 on the sheet feeder 70 relative to the columns 93, 97, 99 on sheet 90. The number of turns of the motor 30 to align the product 74 with the next column is known as the pitch.

The number of columns on the sheet 90 may be varied as the controller 32 may be programmed to stop at any point in a row for delivering product to the column. The columns on a sheet may be sections in a box, or any other segmented array to be filled. The controller 32 may be programmed to fill in every other opening or some other pattern and another sheet feeder 70 on another linear table 70 may fill in the remaining pockets 95 with another product as the conveyor 90 is indexed. Alternatively two separate items may be added to each pocket with the use of two sheet feeders 70 on two linear tables 10 over the same conveyor 80.

The controller 32 may control the speed of the motor 30 and the speed of the sheet feeder 70 and the conveyor 80 as well as the distances each moves for product delivery to the right place at the right time.

The conveyor may be any means of advancing containers having rows and columns of product containing segments, such as an arm pushing a series of boxes along a table.

Obviously, many modifications and variations of the present invention are possible in light of the above teachings. It is therefore to be understood that, within the scope of the appended claims, the invention may be practiced otherwise than as specifically described.

What is claimed is:

1. A product delivery apparatus comprising:

a container indexing device for indexing rows of product receiving spaces in a container having rows and columns of product receiving spaces, a sheet feeding machine with a tray for containing a stack of product and a discharge mechanism for removing product from the tray and dispensing product, a linear motion table for supporting the sheet feeding machine such that the sheet feeding machine is translated perpendicular to the indexing of the container indexing device, whereby columns of product receiving spaces can be filled in the container, a controller for controlling, (a) the container indexing device to index a row of product receiving spaces in the container, (b) the linear motion table to translate the sheet feeding machine to position the sheet feeding machine over each column of the container, (c) the sheet feeding machine to deliver product to receiving spaces in the container, such that arrays of product receiving spaces in a container are filled by translating the sheet feeding machine over the rows, stopping the sheet feeding machine over each column in the rows, and dispensing a product from the sheet feeding machine into the product receiving spaces adjacent the sheet feeding machine, then indexing the container and filling the next row with product until the container is filled.

2. A product delivery apparatus as in claim 1 wherein, the linear motion table has a movable plate for supporting and moving the sheet feeding machine and a controllable motor connected to the plate for pitching the sheet feeding machine to a desired position.

3. A product delivery apparatus as in claim 2 wherein, the motor has a shaft with a pulley thereon, a drive belt engages the pulley on the motor shaft, a first idler shaft having block bearings which are attached to the linear motion table the idler shaft having a pulley for engaging the drive belt to receive power from the motor, a second idler shaft having block bearings which are attached to the linear motion table, the first and second idler shafts having idler pulleys thereon, a translation belt for engaging the idler pulleys on the first and second idler shafts such that the motor moves the translation belts, a belt clamp attached to the plate for sandwiching the translation belt between the belt clamp and the plate, such that the motor positions the plate.

4. A product delivery apparatus as in claim 3 wherein, a pair of rods one on either side of the plate each rod having bearings sliding on the rods for slidably connecting the plate to the rods the rods having holding blocks at each end thereof for attachment to the linear motion table.

5. A product delivery apparatus as in claim 1 wherein, a control box attached to the linear motion table contains the controller and has adjustment settings for controlling the pitch of the linear motion table, the speed of the linear motion table, the indexing of the conveyor belt and the dispensing of product from the sheet feeding machine.

6. A product delivery apparatus as in claim 2 wherein, at least one switch on the linear motion table to engage the plate when the plate passes the at least one switch to provide information on the plate position to the controller.

7. A product delivery apparatus as in claim 4 wherein, the linear motion table has a top with linear slots therein, the plate has posts for extending through the linear slots in the linear motion table, the sheet feeding machine engages and is supported by the posts on the plate.

* * * * *